US005584768A

United States Patent [19]

Lee

[11] Patent Number: 5,584,768

[45] Date of Patent: Dec. 17, 1996

[54] GOLF BALL PUTTING AID

[76] Inventor: Do W. Lee, 1808 Daeyeon-Dong, Daeyeonsamikbeach Apt. 105-1103, Nam-Ku, Pusan, Rep. of Korea

[21] Appl. No.: 421,484

[22] Filed: Apr. 13, 1995

[30] Foreign Application Priority Data

Feb. 24, 1995 [KR] Rep. of Korea ..... 95-3347

[51] Int. Cl.[6] ..... A63B 69/36

[52] U.S. Cl. ..... 473/190

[58] Field of Search ..... 273/181 C, 184 A, 273/58 E, 348, 378, 381, 382, 386, 390; 473/190

[56] References Cited

U.S. PATENT DOCUMENTS 268,895 12/1882 Hoar ..... 273/381

518,930 4/1894 Allen ..... 273/336

2,784,526 3/1957 Bounadere ..... 273/58 E X 3,888,488 6/1975 Sims ..... 273/386 X

*Primary Examiner*—William H. Grieb

*Attorney, Agent, or Firm*—Birch, Stewart, Kolasch & Birch, LLP

[57] ABSTRACT

A golf ball putting aid includes a bell member, a pin member for driving into the ground, and a resilient member for resiliently connecting to the bell member and the pin member, whereby when the golfer hits the golf ball toward the golf ball putting aid, the golfer can listen for the bell ring without having to lift his head. The golf putting aid helps a golfer break himself of the bad habit of lifting his head during a putting stroke. This helps to improve his and her putting proficiency.

11 Claims, 4 Drawing Sheets

GOLF BALL PUTTING AID

BACKGROUND OF THE INVENTION

1. Field of the Invention

The present invention relates to an improved golf ball putting aid for use by a golfer. The golf ball putting aid is used to train and practice hitting and putting a golf ball more accurately.

2. Description of Related Art

Various types of golf putting practice devices for training and practicing putting a golf ball are generally known in the art to be utilized with a golf ball putting practice pad having a hole, and a guide device consisting of a flat rectangular shaped base and a pair of elongated vertically spaced apart and parallel side rails.

However, these golf ball putting devices suffer from a number of problems such as, for example, it is easy for the user to lift his head up so as to see and confirm that the hit golf ball is on target or not, and it is difficult for the user to perceive rectilinear movement of the putter.

SUMMARY OF THE INVENTION

Accordingly, it is an object of the present invention to provide an improved golf ball putting aid for use by a golf putter for a person to train and practice putting a golf ball more accurately, which eliminates the above problems encountered with conventional golf putting practice devices.

A further object of the present invention is to provide a golf ball putting aid which is provided with a bell having a resilient bell neck and a supporting pin for securing the device into the ground such as a golf green. Accordingly, when the user trains and practices by use of the device of the present invention, the golf ball is allowed to actually hit the device. The golfer listens for the bell to ring without lifting his head up so as to give the user the same feeling as seeing the original golf ball going in the hole.

Still another object of the present invention is to provide a golf putting practice guiding device which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a golf putting aid including a bell member, a pin member for driving into the ground, and a resilient member for resiliently connecting to the bell member and the pin member, whereby when the golfer hits the golf ball toward the golf ball putting aid, the golfer can listen for the ringing of the bell without having to lift his or her head. The golf putting aid helps a golfer break himself of the bad habit of lifting his head during a putting stroke. This helps to improve his and her putting proficiency.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
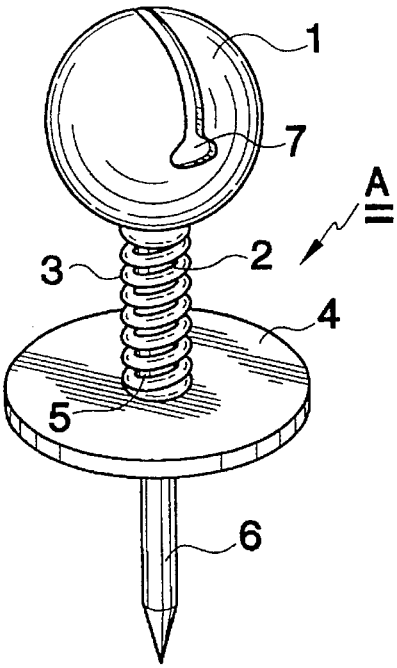
FIG. 1 is a perspective view of a golf ball putting aid in accordance with the present invention.
Figure 2:
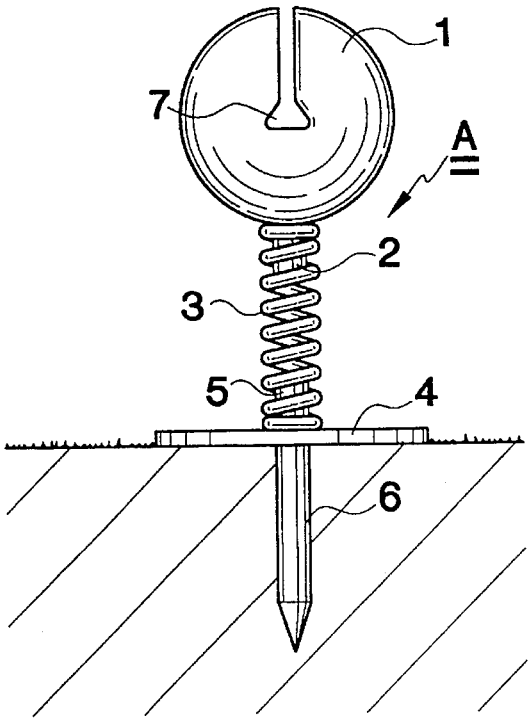
FIG. 2 is a front view of the golf ball putting aid in accordance with the present invention shown in the ground.

Referring now in detail to the drawings for the purpose of illustrating the preferred embodiments of the present inventions. The improved golf ball putting aid A for use by a golfer as shown in FIGS. 1, 2 and 3 includes a bell 1 for ringing, a pin 6 for driving into the ground and a resilient member 3 such as a spring for resiliently connecting the bell 1 and the pin for forming the golf ball putting aid (A) according to the present invention.

Figure 3:
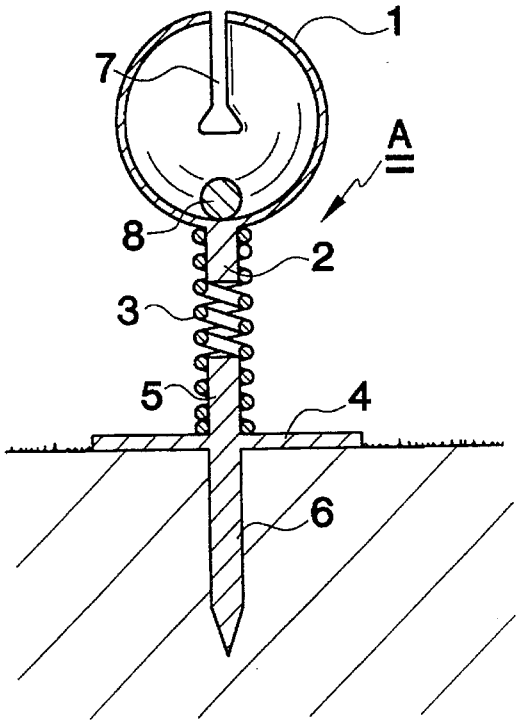
FIG. 3 is a sectional view of FIG. 2.

As shown in FIG. 3, the bell 1 includes a slit 7 disposed on the upper portion thereof for enhancing the ringing of the bell. A movable weight ball 8 is disposed within the bell 1 for hitting the surface of the bell 1 when the golf ball 109 (FIGS. 4 and 5) hits the golf ball putting aid (A). A bell connecting rod 2 extends from the bell for connection with the resilient member 3. The bell 1 has a diameter of about 15 cm. to 20 cm. and has a smaller size than a hole on the golf green.

Figure 6:
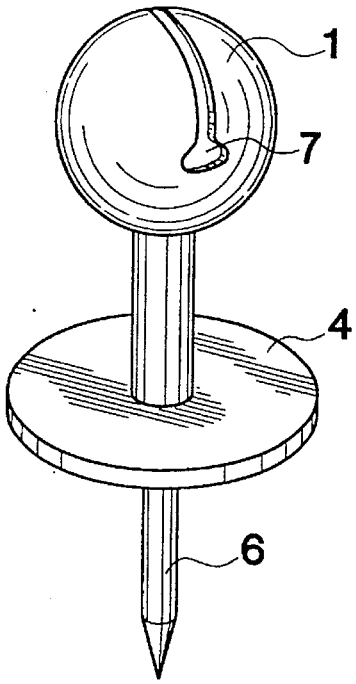
FIG. 6 is a perspective view of a golf ball putting aid having a flexible pipe resilient member.
Figure 7:
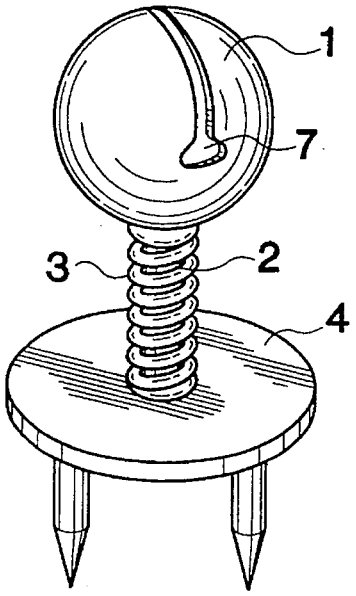
FIG. 7 is a perspective view of a golf ball putting aid having two separate pins.
Figure 8:
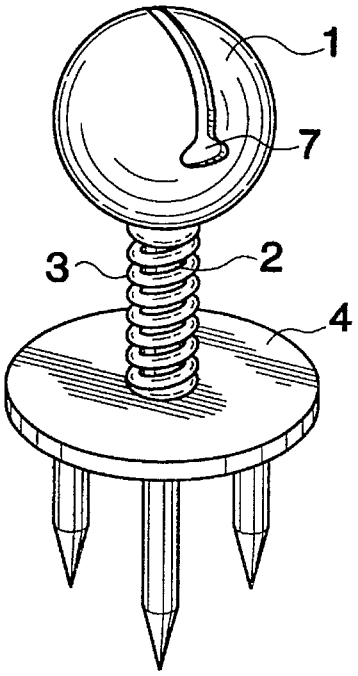
FIG. 8 is a perspective view of a golf ball putting aid having three separate pins.

The pin 6 includes a round stand plate 4 attached to the pin 6 in a right angle for stopping against the ground or a kind of carpet material when the pin 6 is inserted. A pin connecting rod 5 vertically extends from the pin 6. The resilient member 3 is connected to the bell connecting rod 2 and the pin connecting rod 5. The resilient member 3 is a spring (FIG. 1), a flexible pipe (FIG. 6), or the like. The pin 6 can be modified to include several separate pins or can have various cross-sections. FIG. 7 shows a modified form of the golf ball putting aid including two pin legs, and FIG. 8 shows another modified form of the golf ball putting aid including three pin legs.

The golf ball putting aid (A) according to the present invention operates as follows. First of all, the pin 6 of the golf ball putting aid (A) is driven into the ground such as a golf green. At this time, the stand plate has a stopper function for stably standing the golf ball putting aid (A) (FIGS. 4 and 5).

Figure 4:
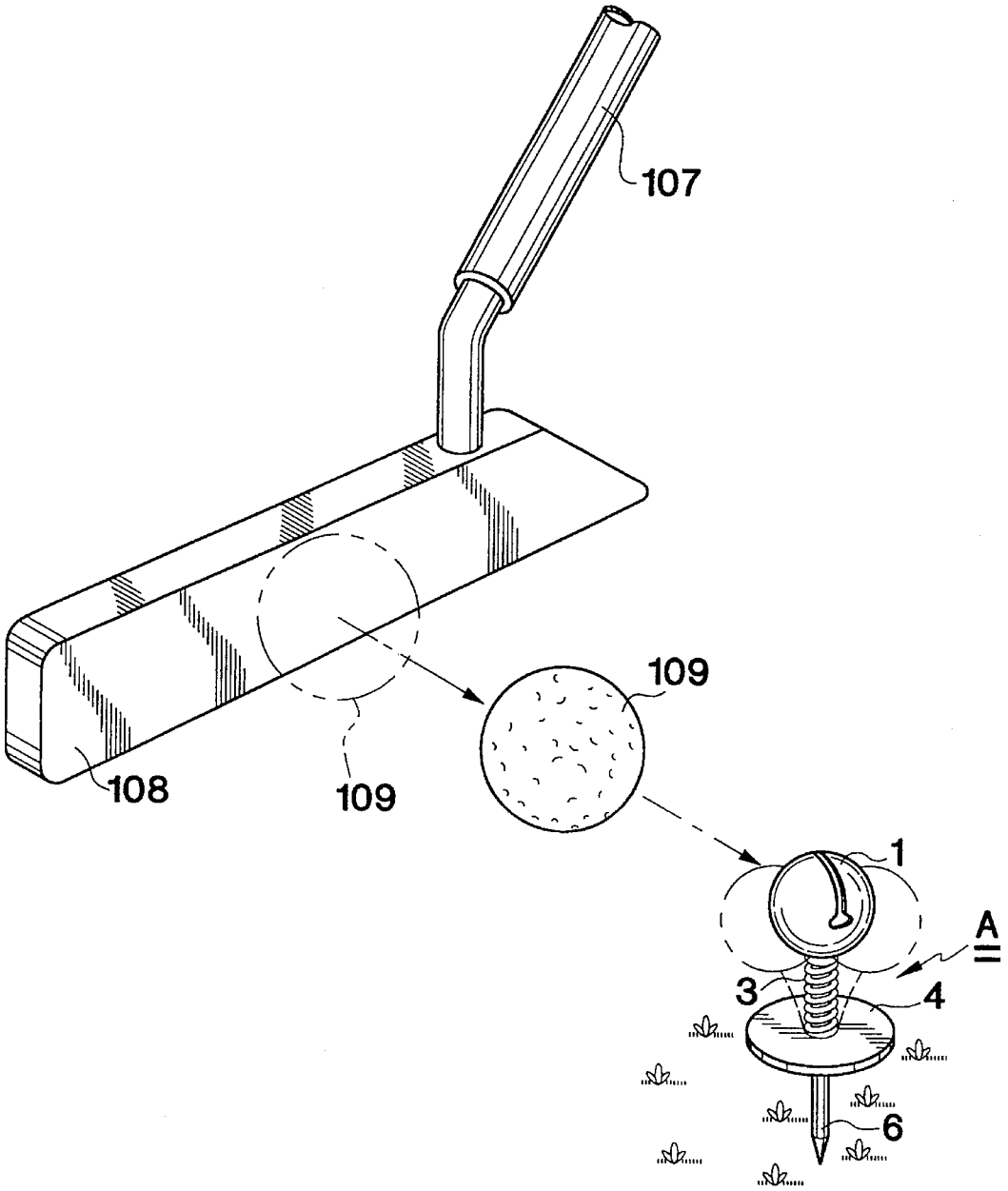
FIGS. 4 and 5 are perspective views of the golf ball putting aid in accordance with the present invention, illustrating the use thereof in putting practice.
Figure 5:
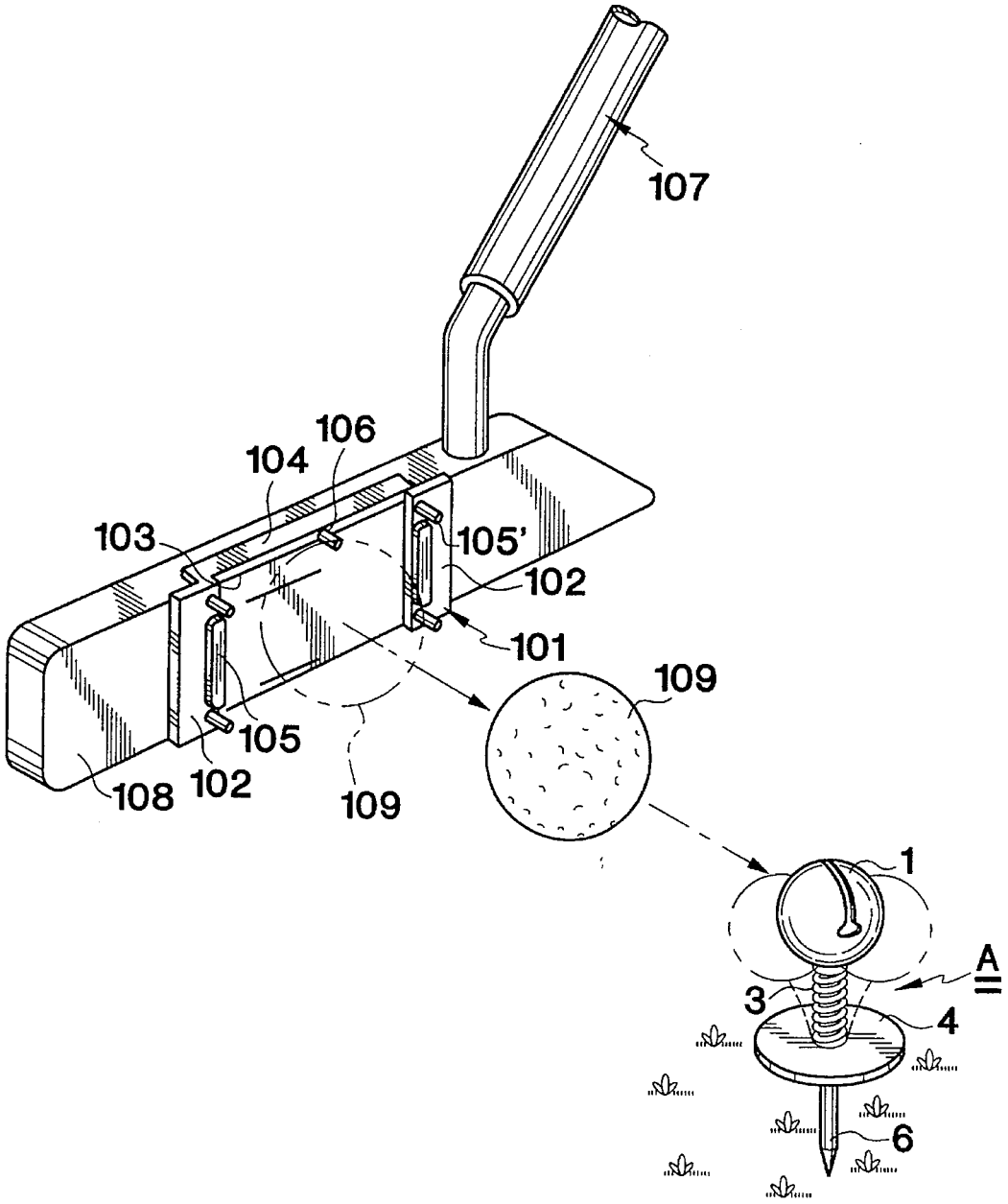

As shown in FIG. 4, when a practicing golfer putts the golf ball 109 by using the head 108 of a golf putter 107, the golf ball 109 if hit correct, hits the bell 1 of the golf ball putting aid (A) of the present invention. Therefore, the weight ball 8 hits the bell 1 several times and the bell 1 rings loudly continuously through the slit 7 of the bell due to shaking of the resilient member 3.

Accordingly, when the practicing golfer repeats putting toward the golf ball putting aid (A), the golf ball moves straight forward in the direction indicated by the arrow as shown in FIG. 4, toward the desired target. At this time, the practicing golfer does not need to lift his head up to see if the ball goes in the hole because the golfer can listen for the sound of the bell. One of the bad habits associated with golf putting is that golfers often lift their heads during a putting stroke to see if a ball will go in the hole. Movement of the head can greatly decrease the accuracy of the putting stroke. The present invention allows a practicing golfer to hold his head still all during a putting stroke and still be able to hear whether the putt was on target.

In addition, it is easy for the practicing golfer to putt the golf ball 109 into the real hole in the golf green since the practicing golfer practices with a target having a smaller size than that of the real hole. Accordingly, it is apparent that the golfer may rapidly improve his and her putting proficiency.

As shown in FIG. 5, the golf putter 107 includes a C-shaped body member 101 attached to a striking face of the putter head 108. The C-shaped body member 101 includes vertically elongated legs 102, and a bridge 104. The front face of the body member 101 includes a pair of vertically elongated rails 105, two pairs of pins 105' and a centrally placed marker pin 106.

When the golf ball 109 is hit solidly and so as to avoid the pair of rails 105, the two pairs of pins 105' and the marker pin 106, it moves straight forward in the direction indicated by the arrow as shown in FIG. 5, toward the desired target. Accordingly, it is apparent that the golfer may rapidly improve his or her putting proficiency.

Accordingly, as shown in FIGS. 4 and 5, the golf ball putting aid according to the present invention permits one to develop a natural putting stroke in a simple and efficient manner without actually fettering or restraining the golf putter 107. If the practicing golfer's swing deviates excessively from the natural swing, the pair of rails 105, the two pairs of pins 105', and marker pin 106 of the golf putter 107 will be touched by the golf ball 109, thus indicating a necessity for correcting the swing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball putting aid comprising:

a bell member including a connecting rod downwardly extending therefrom;

a pin member having at least one pin leg for driving into the ground, said pin member including a round stand plate for stopping against the ground, and a vertical connecting pin extending upwardly from the round stand plate; and a resilient member flexibly connected between said bell member and said vertical connecting pin, said resilient member extending continuously from said round stand plate to said bell member, whereby said bell member is rung when a golf ball strikes said golf ball putting aid, providing an audible signal to a golfer putting said golf ball.

2. The golf ball putting aid of claim 1, wherein said resilient member is a spring.

3. The golf ball putting aid of claim 1, wherein said resilient member is a flexible rod.

4. The golf ball putting aid of claim 1, wherein said at least one pin leg includes two pin legs.

5. The golf ball putting aid of claim 1, wherein said at least one pin leg includes three pin legs.

6. The golf ball putting aid of claim 1, wherein said bell member is spherical in shape and includes a slit disposed on an upper portion thereof and a movable weight disposed inside.

7. The golf ball putting aid of claim 1, wherein said bell member is smaller in diameter than a hole in a putting green.

8. A golf ball putting aid comprising:

a hollow bell member having a slit therein;

a movable weight disposed inside of said hollow bell member;

a base member for placement on a playing surface;

a resilient member flexibly connected between said bell member and said base member; and a connecting rod downwardly extending from said hollow ball member and connected with said resilient member, whereby said bell member is rung when a golf ball strikes said golf ball putting aid, providing an audible signal to a golfer putting said golf ball.

9. The golf ball putting aid according to claim 8, and further including at least one pin leg formed on a lower surface of said base member for driving into said playing surface.

10. The golf ball putting aid according to claim 8, and further including a vertical connecting pin extending upwardly from said base member and connected with said resilient member.

11. The golf ball putting aid according to claim 8, and further including at least one pin leg formed on a lower surface of said base member for driving into said playing surface;

a connecting rod extending from said hollow bell member and connected with said resilient member; and a vertical connecting pin extending upwardly from said base member and connected with said resilient member.

* * * * *